United States Patent [19]

Pelcin

[11] 4,126,340

[45] Nov. 21, 1978

[54] DETENT SYSTEM FOR RELEASABLY RETAINING RELATIVELY MOVABLE MEMBERS IN PREDETERMINED POSITIONS

[75] Inventor: Albert L. Pelcin, Aurora, Ohio

[73] Assignee: The Eastern Company, Cleveland, Ohio

[21] Appl. No.: 802,884

[22] Filed: Jun. 2, 1977

[51] Int. Cl.[2] ..... E05C 13/02

[52] U.S. Cl. ..... 292/1; 292/336.3; 292/31; 292/107

[58] Field of Search ..... 292/336.3, 204, 207, 292/147, 150, 103, 106, 1; 339/255, 256, 259

[56] References Cited

U.S. PATENT DOCUMENTS

| | | | |
|---|---|---|---|
| 2,011,455 | 8/1935 | Ostermann | 292/103 X |
| 2,217,485 | 10/1940 | Kliegl | 292/103 |
| 3,052,867 | 9/1962 | Rogoff | 339/255 R |
| 3,436,860 | 4/1969 | James | 292/103 X |

*Primary Examiner*—Richard E. Moore
*Attorney, Agent, or Firm*—David A. Burge Co.

[57] ABSTRACT

A detent system is provided for releasably retaining a pair of relatively movable members of a lock assembly or other mechanism in one or more predetermined positions. The members are movable relative to each other to successively present a series of contiguous surface portions on one of the members in spaced, side-by-side relationship with a selected part of the other member. A hole is formed through the part, and a detent element is movably carried in the hole. The detent element has a rounded tip which is projectable from the hole for engaging the contiguous surface portions as the members move relative to each other. A detent receiving formation is provided at a location along the contiguous surface portions and is adapted to receive the rounded tip of the detent element when the members are in a predetermined relative position. A U-shaped spring clip is carried on the part and serves the several functions of retaining the detent element in the hole, of biasing the tip of the detent element into engagement with the contiguous surface portions, and of biasing the rounded tip into receiving engagement with the receiving formation when the members are in the predetermined position. The spring clip has formations on its legs which cooperate with the detent element to assist in retaining the spring clip in position on the part.

27 Claims, 12 Drawing Figures

DETENT SYSTEM FOR RELEASABLY RETAINING RELATIVELY MOVABLE MEMBERS IN PREDETERMINED POSITIONS

BACKGROUND OF THE INVENTION

1. Field of the Invention

The present invention relates generally to a novel and improved detent system for selectively releasably retaining relatively movable members in one or more predetermined relative positions.

2. Prior Art

Detent systems for selectively releasably retaining a pair of relatively movable members in one or more predetermined relative positions are known. Such systems ordinarily employ a detent element such as a hardened steel ball carried in a hole formed in one of the members. Either a leaf spring or a compression coil spring is provided to bias the ball toward engagement with one or more spaced ball-receiving formations provided on the other of the members.

Where a compression coil spring has been used to bias the ball, the member in which the ball and the spring are carried must be of relatively substantial thickness in order to define a closed-ended hole of sufficient length to receive the ball and the spring. Providing the mounting member with this substantial thickness often adds undesirably to the cost of the assembly, as does the relatively expensive process of accurately forming the required closedended hole.

Where a leaf spring has been used to bias the ball, some means must be provided for securing the leaf spring to the ball-carrying member. In many instances, the leaf spring has been riveted or welded in place, which procedure complicates assembly and adds to the cost of the system.

A problem common to almost all previous detent system proposals is that of obtaining access to the detent system components for service and replacement after extensive use. Most prior proposals require the disassembly of a substantial number of parts to obtain access to the ball detent and its biasing spring, and to permit their replacement.

SUMMARY OF THE INVENTION

The present invention overcomes the foregoing and other drawbacks of prior proposals by providing a novel and improved, simple and inexpensive, readily serviceable detent system for use in selectively releasably retaining a pair of relatively movable members in one or more predetermined relative positions.

As will become apparent from the description which follows, a novel and significant feature of the invention resides in the cooperation which is achieved between a detent element and its biasing spring, whereby each of these elements cooperates to retain the other in place on one of the relatively movable members.

In accordance with the preferred practice of the present invention, one of two relatively movable members is provided with a series of contiguous surface portions. The members are relatively movable to successively present the series of contiguous surface portions in spaced, side-by-side relationship with a selected part of the other of the members. The part has one side which faces toward the contiguous surface portions, and has an opposite side. A hole is formed through the part and has one and opposite ends which open respectively through the one and opposite sides. A detent element is movably carried in the hole and has a tip which is projectable from the one hold end. A detent receiving formation is provided at a selected location along the contiguous surface portions for receiving the tip of the detent element when the members are in a predetermined relative position. A spring clip is carried on the part and has a pair of legs which extend respectively along the one and opposite sides. The leg extending along the opposite side engages the detent element and biases it into engagement with the contiguous surface portions.

Despite the extremely simple and inexpensive character of the detent system, its components cooperate in several significant and subtle ways to provide a highly reliable, effective and readily serviceable system. The spring clip not only serves the several functions of retaining the detent element in the mounting hole, of biasing the detent element toward a position of engagement with the contiguous surface portions, and of projecting the detent element into the receiving formation when the relatively movable members are in their predetermined position, but also has retaining formations on its legs which cooperate with the detent element to assist in holding the spring clip in place on the part. The retaining formations include a hole formed through one leg of the spring clip and an elongated slot formed through the other leg of the spring clip. The spring clip is of U-shaped construction and has curved portions interconnecting its legs which grip the part to assist in holding the clip in place.

A feature of the detent system is that its components can be easily disassembled for service or replacement as may be required after extensive use. The spring clip can be snapped off of the part on which it is carried thereby permitting the detent element to be removed for lubrication or replacement.

Still another feature of the detent system of the present invention is that it is useable between members which are movable in a variety of relative modes. The system is well adapted for use between members which move relative to each other along a straight, linear path. It is equally well adapted for use between members which rotate relative to each other in parallel planes. It is also well adapted for use between members which rotate relative to each other in nonparallel planes. Still other uses of the detent system will be apparent to those skilled in the art.

As will be apparent from the foregoing summary, it is a general object of the present invention to provide a novel and improved, simple and inexpensive, detent system for releasably retaining relatively movable members in one or more predetermined positions.

Other objects of the invention include the provision of a detent system of the type described which utilizes a minimal number of parts, which has components that snap in place to simplify assembly, which requires no fasteners to hold its components in place, and which is readily disassemblable for service or replacement without requiring disassembly of the relatively movable members on which it operates.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 10:
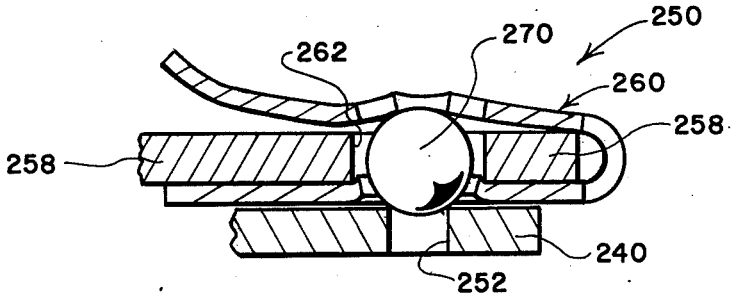
FIG. 10 is an enlarged sectional view as seen from a plane indicated by a line 10—10 in FIG. 9.

In the description which follows, three example embodiments are described, each utilizing substantially identical detent systems. The substantially identical character of the detent systems used in all three embodiments will be apparent from a comparison of the cross-sectional views presented in FIGS. 5, 10 and 12.

Figure 1:
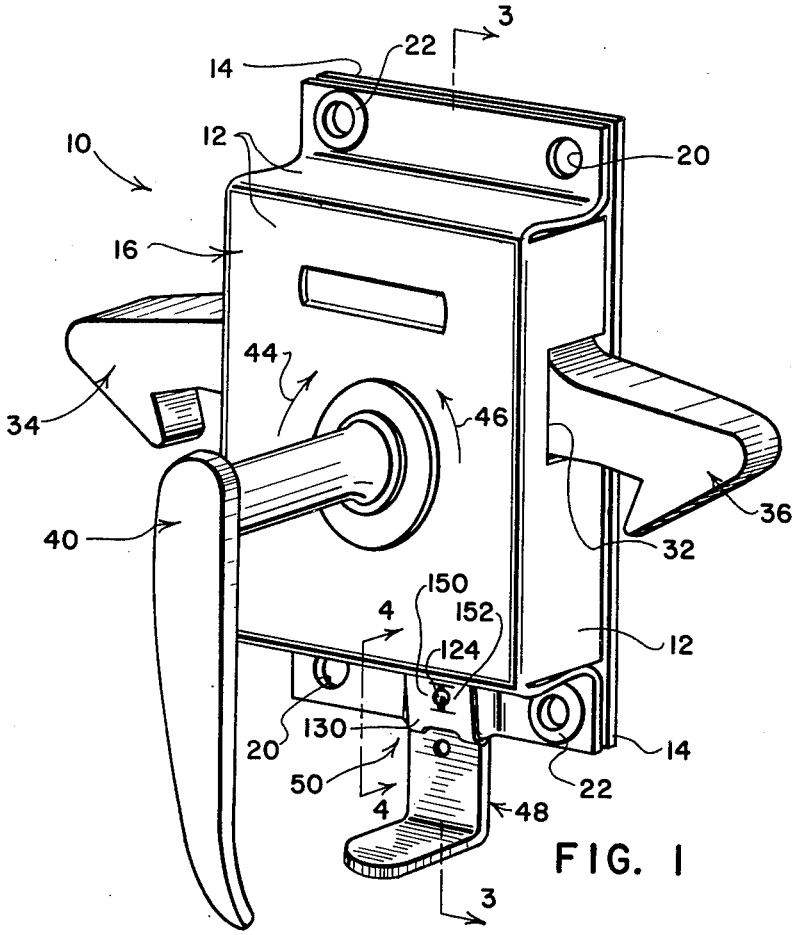
FIG. 1 is a perspective view of one embodiment of a lock assembly employing the ball-detent system of the present invention between relatively movable components of the lock assembly.
Figure 2:
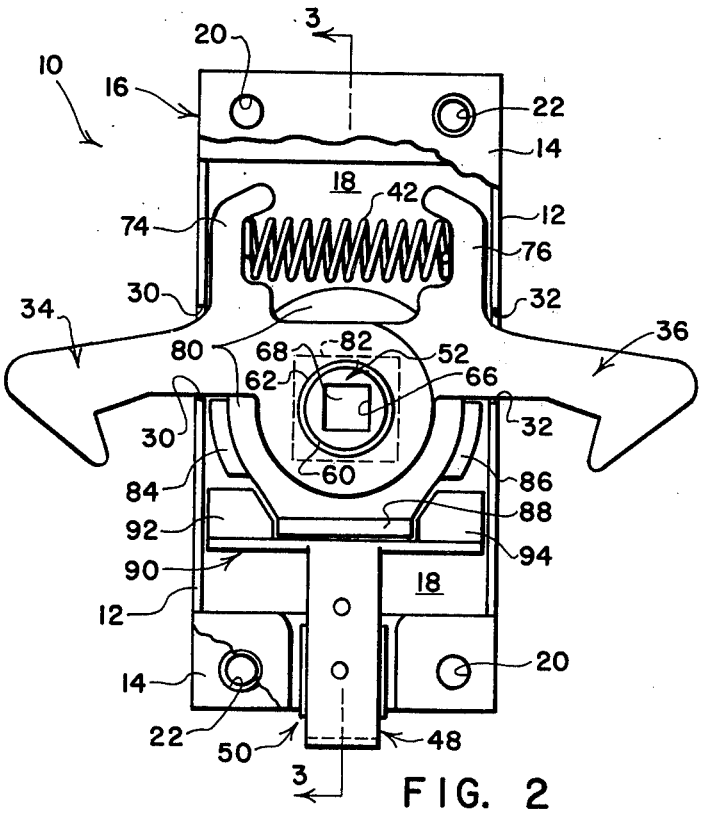
FIG. 2 is a rear elevational view of the lock assembly of FIG. 1 with portions of the backplate broken away to expose internally housed components of the lock assembly.
Figure 3:
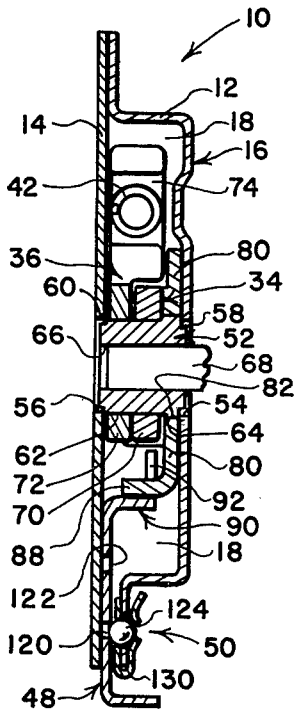
FIG. 3 is a sectional view as seen from a plane indicated by lines 3—3 in FIGS. 1 and 2.
Figure 4:
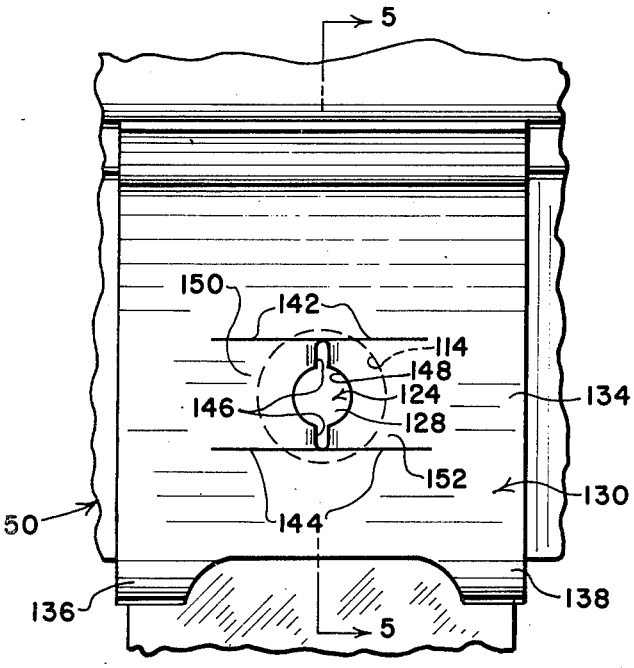
FIG. 4 is an enlarged front elevational view of a portion of the lock assembly of FIG. 1 as seen from a plane indicated by a line 4—4 in FIG. 1.

Referring to FIGS. 1-3, one embodiment of a lock assembly is indicated generally by the numeral 10. The lock assembly 10 has a stamped front plate 12 and a substantially planar back plate 14. The plates 12, 14 cooperate to define a housing assembly 16 with a chamber 18 between central portions of the plates 12, 14. Aligned mounting holes 20 are provided in opposite end portions of the plates 12, 14 to receive suitable fasteners (not shown) for mounting the lock assembly 10 on a sliding door or other suitable closure member (not shown). A pair of eyelets 22 are positioned in two of the mounting holes 20 to clamp the plates 12, 14 together.

A pair of rectangular openings 30, 32 are provided in opposite sides of the housing assembly 16. Latch members 34, 36 project through the openings 30, 32 for engagement with suitable strikes (not shown) to retain a sliding door, or other closure member on which the lock assembly 10 is mounted, in open and/or closed positions.

As will be explained in greater detail, the latch members 34, 36 are journaled for movement about the axis of rotation of a handle assembly 40. A compression coil spring 42 biases the latch members to the latched positions shown in FIGS. 1 and 2. When the handle assembly 40 is rotated a few degrees in a clockwise direction, as indicated by an arrow 44 in FIG. 1, the latch member 34 is caused to rotate clockwise to effect an unlatching movement. When the handle assembly 40 is rotated a few degrees in a counterclockwise direction, as indicated by an arrow 46 in FIG. 1, the latch member 36 is caused to rotate counterclockwise to effect an unlatching movement.

As will also be explained in greater detail, a thumb-operated slide 48 is supported between the plates 12, 14 for sliding movement between retracted and extended positions where the slide 48 selectively prevents and permits rotation of the handle assembly 40. A detent system 40 embodying the preferred practice of the present invention is interposed between the housing assembly 16 and the slide 48 to selectively releasably retain the slide in its retracted and extended positions.

The handle assembly 40 operates to rotate a hub 52 which is journaled by the housing assembly 16. Referring to FIGS. 2 and 3, aligned holes 54, 56 are formed through the front and back plates 12, 14. The hub 52 has opposite end regions 58, 60 journaled in the holes 54, 56. The hub 52 has cylindrical and square-shaped outer wall portions 62, 64 located side-by-side between the journaled end regions 58, 60. A square hole 66 is formed centrally through the hub 52 and extends along the axis of rotation of the hub 52. The handle assembly 40 has a square shaft 68 which extends into the square hole 66 to establish a driving connection between the handle assembly 40 and the hub 52.

The latch members 34, 36 are mounted on the hub 52 for independent rotation. As is best seen in FIG. 3, the latch members 34, 36 have central portions 70, 72 which are journaled in side-by-side relationship on the cylindrical outer wall portion 62 of the hub 52. The latch members 34, 36 are not drivingly interconnected and are free to rotate independently relative to each other and relative to the hub 52.

The compression coil spring 42 is interposed between the latch members 34, 36 and operates to bias the latch members 34, 36 toward their latched positions. As is best seen in FIG. 2, the latch members 34, 36 have upstanding arm portions 74, 76 located inside the housing chamber 18. Opposite ends of the compression coil spring 42 engage the arm portions 74, 76, biasing the latch member 34 counterclockwise toward its latched position, and biasing the latch member 36 clockwise toward its latched position.

A tumbler disc 80 operates to selectively drivingly connect the latch members 34, 36 with the hub 52 for rotation in response to rotational movements of the handle assembly 40. Referring to FIGS. 2 and 3, the tumbler disc 80 has a square hole 82 formed through its center. The tumbler disc 80 is positioned on the hub 52 with the square hole 82 drivingly receiving the square-shaped outer wall portion 64 of the hub 52. Three circumferentially spaced tumbler projections 84, 86, 88 are provided along the circumference of the tumbler disc 80. The projection 84 is configured to drivingly engage the underside of the latch arm 34 when the latch arm 34 is in its latched position. The projection 86 is configured to drivingly engage the underside of the latch arm 36 when the latch arm 36 is in its latched position. When the handle assembly 40 is rotated clockwise, as indicated by the arrow 44 in FIG. 1, the driving engagement between the projection 84 and the latch arm 34 will cause the latch arm 34 to rotate clockwise. When the handle assembly 40 is rotated counterclockwise, as indicated by the arrow 46 in FIG. 1, the driving engagement between the projection 86 and the latch arm 36 will cause the latch arm 36 to rotate counterclockwise. A feature of the type of driving connection provided between the tumbler disc 80 and the latch arms 34, 36 is that it permits the handle assembly 40 to selectively, independently move the latch members 34, 36.

The thumb-operated slide 48 is movable between retracted and extended positions where it cooperates with the tumbler disc projection 88 to selectively prohibit and permit rotation of the handle assembly 40. As is best seen in FIG. 2, the slide 48 has a U-shaped upper end portion 90 including spaced stops 92, 94. When the slide 48 is in its upward or "retracted" position, as shown in FIGS. 2 and 3, the stops 92, 94 engage opposite ends of the projection 88 and prevent rotation of the tumbler disc, the hub, and the handle assembly 80, 52, 40. When the slide 48 is in its downward or "extended" position, as shown in FIG. 1, the stops 92, 94 reside in the lower portion of the chamber 18 and do not engage the projection 88, whereby the handle assembly 40 can be rotated to operate the latch members 34, 36.

With the exception of the detent assembly 50, the above-described featues of the lock assembly 10 are known and have been on sale in the United States for more than one year prior to the filing of the present application. Locks of this type have been sold by Eberhard Manufacturing Company, Division of The Eastern Company, under model designation Nos. 5690 and 5696-½. In such lock models as Nos. 5690 and 5696-½, the thumb-operated slide 48 has either been retained in its retracted and extended positions by frictionally engaged interfitting formations and/or through the use of a leaf spring which increases the frictional forces interposed between the slide 48 and the housing assembly 16.

Figure 5:
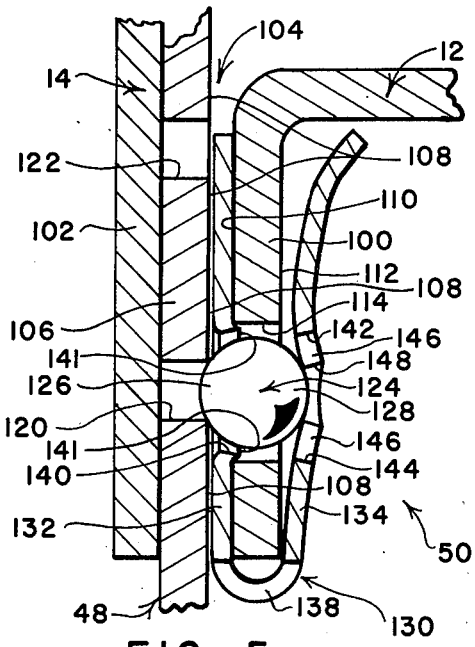
FIG. 5 is a sectional view as seen from a plane indicated by line 5—5 in FIG. 4.
Figure 6:
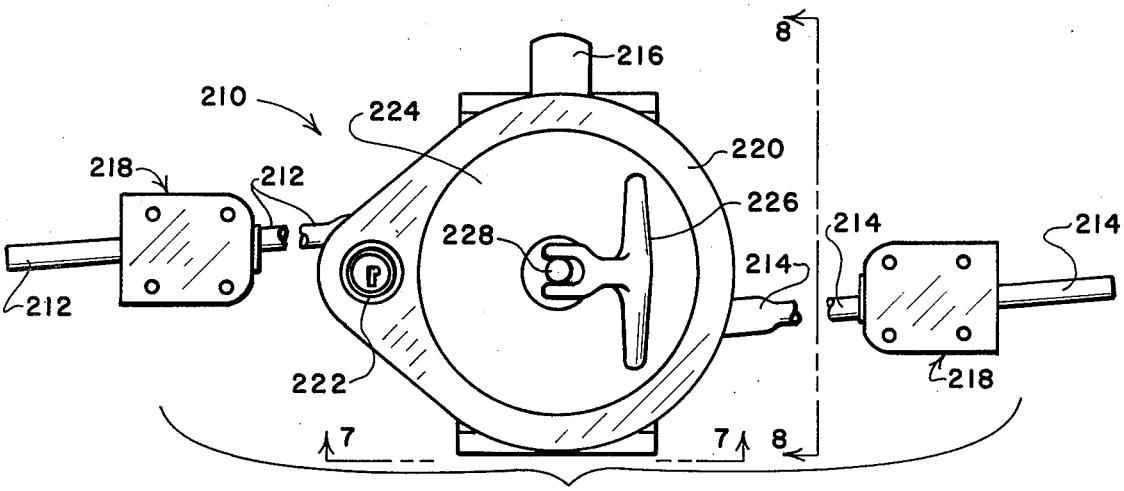
FIG. 6 is a front elevational view of another embodiment of a lock assembly employing the ball detent system of the present invention between a pair of its relatively movable components, with portions of its rod locking arms foreshortened.
Figure 7:
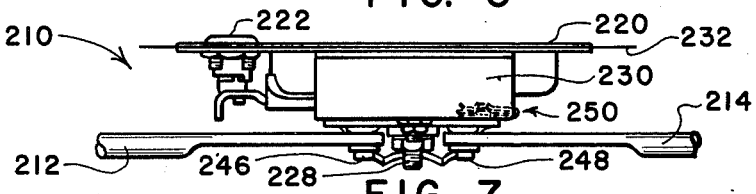
FIG. 7 is a side elevational view of portions of the lock assembly of FIG. 6 as seen from a plane indicated by line 7—7 in FIG. 6.
Figure 8:
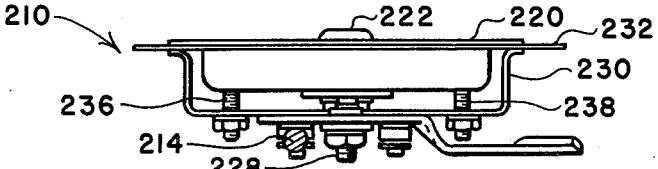
FIG. 8 is a side elevational view of portions of the lock assembly of FIG. 6 as seen from a plane indicated by a line 8—8 in FIG. 6.

In accordance with the present invention, a novel and improved detent system 50 of extremely simple and reliable construction is interposed between the slide 48 and the housing assembly 16 to selectively releasably retain the slide 48 in its retracted and extended positions. As is best seen in FIG. 5, the front and back plates 12, 14 have spaced lower end parts 100, 102 which define a channel 104 within which the slide 48 is slidably movable. The slide 48 has a central region 106 along which a series of contiguous surface portions 108 are defined. The contiguous surface portions 108 face toward the front plate part 100 and are presented sequentially alongside the front plate part 100 when the slide 48 is moved relative to the housing assembly 16 between its extended and retracted positions.

The front plate part 100 has one side surface 110 which faces toward the slide portion 106, and has an opposite side surface 112. A hole 114 is formed through the front plate part 100, and has one end opening through the one side surface 110 facing toward the contiguous surface portions 108, and an opposite end opening through the opposite side surface 112.

The slide portion 106 has a pair of holes 120, 122 formed at vertically spaced locations. The holes 120, 122 are of a smaller diameter than the hole 114. When the slide 48 is in its upward or "retracted" position, the hole 120 aligns with the hole 114. When the slide 48 is in its downward or "extended" position, the hole 122 aligns with the hole 114. The slide portion holes 120, 122 constitute detent element receiving formations which face toward the front plate part 100.

A detent element, here taking the form of a hardended steel ball 124, is loosely positioned in the hole 114 for movement toward and away from the slide portion 106. The ball 124 has a tip portion 126 which projects from the hole 114 toward the contiguous surface portions 108, and a spring engagement portion 128 which projects from the opposite end of the hole 114. When the slide 48 is in its retracted position, the projecting tip portion 126 is received in the hole 120. When the slide 48 is in its extended position, the projecting tip portion 126 is received in the hole 122.

A U-shaped spring clip 130 is carried on the front plate part 100. The spring clip 130 has an inner leg 132 which extends along the one side surface 110, and an outer leg 134 which extends along the opposite side surface 112. The legs 132, 134 are interconnected by a pair of spaced, curved bottom portions 136, 138. A hole 140 is formed through the inner leg 132 in alignment with the hole 114, and has a diameter sufficient to let the ball 124 pass therethrough. Portions 141 of the inner leg 132 surrounding the hole 140 project into the mounting hole 114 to assist in retaining the spring clip 130 in place on the front plate part 100.

Three cuts 142, 144, 146 are formed in an H-shaped arrangement in the outer leg 134. The cuts 142, 144 extend in spaced parallel arrangement along top and bottom sides of the hole 114. The cut 146 extends transversely between the cuts 142, 144, diametrically of the hole 114. The cut 146 has an enlarged central portion 148 which receives the spring-engaging portion 128 of the ball 124. The cuts 142, 144, 146 define a pair of spring tabs 150, 152 which cooperate with other portions of the outer leg 134 to bias the ball 124 toward the slide portion 146.

There are several subtle but significant ways in which the spring clip 130 and the ball 124 cooperate to provide a reliable, effective, and extremely simple detent system. Both of these parts serve multiple functions. The spring clip 130 serves the several functions of retaining the ball 124 in the hole 114, of biasing the ball 124 toward a position of engagement with the contiguous surface portions 108, and of projecting the ball portion 126 into one of the holes 120, 122 when the slide 48 is in its extended and or retracted positions. Moreover, the spaced spring clip portions 136, 138 retain alignment of the spring clip 130 on the front plate part 100 and grip the front plate part 100 to hold the spring clip in position. The ball 124 not only serves the function of a detent element to selectively retain the slide 48 in its retracted and extended positions, but also serves to hold the spring clip 130 on the front plate part 100. As will be apparent, since the tip 126 of the ball 124 projects through the hole 140 formed in the spring clip leg 132, the ball 124 operates to help retain the spring clip on the front plate part 100. The engagement between the elongated opening 148 and the ball portion 128 also helps to retain the spring clip 130 in position on the front plate part 100. Accordingly, the openings 140, 148 can be thought of as formations which cooperate with the ball 124 to help retain the spring clip 130 in place on the part 100.

When the elements of the detent system 50 require service or replacement after extensive use, a tool can be inserted between the lower portions 136, 138 and the lower end of the front plate portion 100, to remove the spring clip 130 from the front plate 12, thereby exposing the ball 124 and permitting it to be removed from the hole 114.

In the lock assembly 10, the detent system 50 is interposed between members which move back and forth relative to each other along an essentially linear travel path. In order to illustrate that the detent system of the present invention is equally applicable to members which are relatively movable in modes other straight-line linear movement, the embodiments of FIGS. 6–10 and 11–12 will now be described.

Referring to FIGS. 6–9, a rod-lock assembly, of the type used on rear and/or side doors of panel delivery trucks and the like, is indicated generally by the numeral 210. The lock assembly 210 includes two projectable-retractable rod-like deadbolt members 212, 214, and a rotatable latch member 216. The members 212, 214, 216 are adapted to be received in suitable recessed strikes (not shown) carried in a truck body at the top and bottom, and at one side of a door on which the lock assembly 210 is mounted. A pair of rod guide assemblies 218 slidably support the deadbolt members 212, 214 for extension and retraction.

The lock assembly 210 includes a casing 220 which carries a key-operated cylinder 222. A circular recess 224 is formed in the casing 220. A T-shaped handle 226 is carried in a folded position in the recess 224, and is extensible from the recess 224 for rotating a shaft 228. The key-operated cylinder 222 cooperates with suitable structure, which need not be described here, to selectively permit and prevent rotation of the shaft 228 by the T-handle 226. A channel-shaped adapter plate 230 is provided on the back side of the casing 220 for mounting the casing 220 securely on a door plate portion, indicated generally by the numeral 232 in FIGS. 7 and 8. Threaded fasteners 236, 238 clamp the adapter plate 230 and rim portions of the casing 220 against opposite sides of the door plate portion 232.

Figure 9:
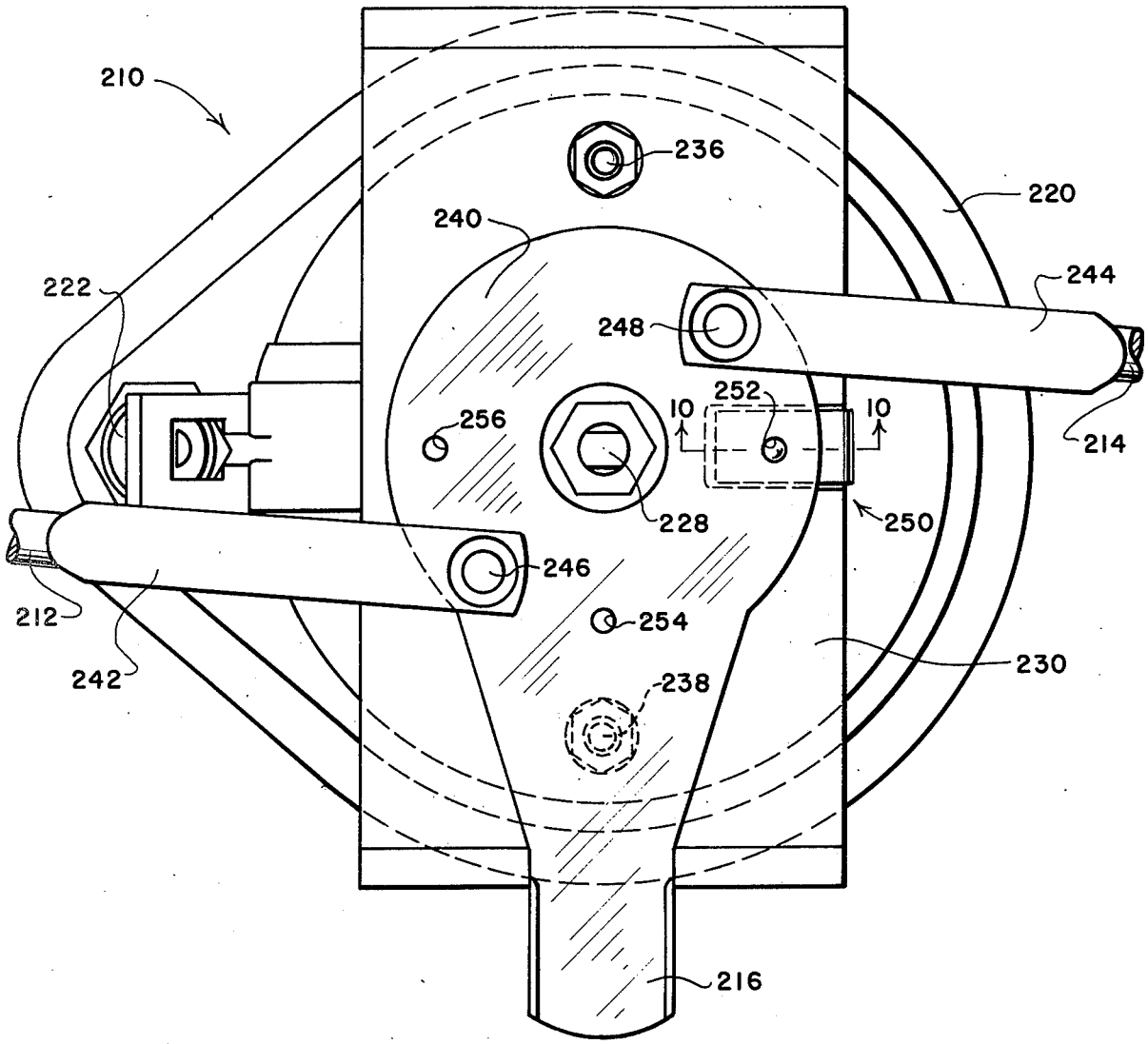
FIG. 9 is an enlarged rear elevational view of portions of the lock assembly of FIG. 6.

Referring to FIG. 9, the rotatable latch member 216 has a central portion 240 which is drivingly connected to the shaft 228 for rotation therewith. The deadbolt members 212, 214 have flattened end regions 242, 244 which are pivotally connected to the rotatable central portion 240 on opposite sides of the axis of the shaft 238 by fasteners 246, 248. When the handle 226 is rotated, the shaft 228 and the latch member 216 rotate with it, causing the deadbolt members 212, 214 to extend or retract, depending on the direction in which the handle 226 is rotated.

Referring to FIG. 9, a detent system 250 is interposed between the rotatable latch member 216 and the adapter plate 230. The detent system 250 includes three holes 252, 254, 256 formed at spaced locations around the circumference of an imaginary circle having as its center the axis of the shaft 228. The plate 230 has a part 258 which carries a spring clip 260. A hole 262 is formed through the part 258. As the latch member 216 rotates to present a series of its successive surface portions in side-by-side relationship with the part 258, the holes 252, 254, 256 are sequentially brought into alignment with the hole 262.

A detent element, in the form of a hardened steel ball 270 is positioned in the hole 262. The ball 270 and the spring clip 260 are identical to the previously described ball 124 and spring clip 130, and operate as described previously to selectively releasably retain the relatively movable members 216, 230 in predetermined positions where the ball 270 is received in one of the holes 252, 254, 256.

Figure 11:
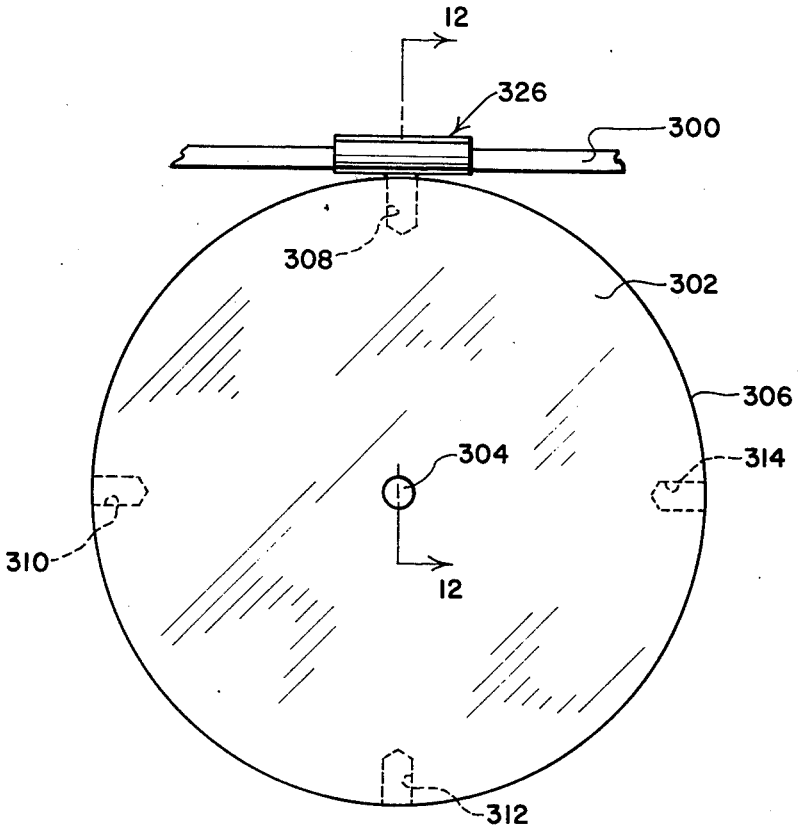
FIG. 11 is a front elevational view of another embodiment including relatively movable members and employing the detent system of the present invention; and, FIG. 12 is an enlarged sectional view as seen from a plane indicated by a line 12—12 in FIG. 11.
Figure 12:
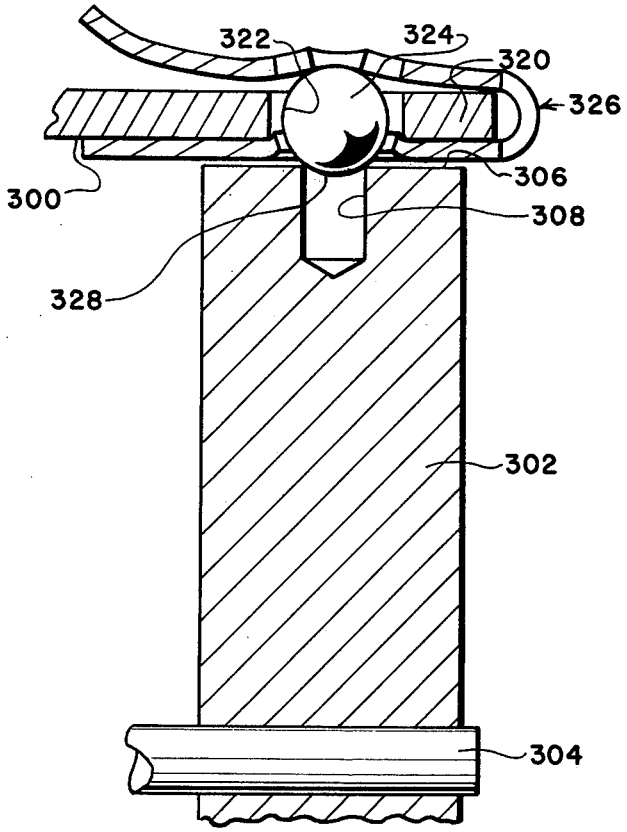

In the embodiment of FIGS. 6–10, the detent assembly 250 is interposed between members which are rotatable relative to each other in substantially parallel planes. Reference will now be made to FIGS. 11 and 12 to illustrate that the detent system of the present invention can be employed equally well between members which move relative to each other in other modes.

In FIGS. 11 and 12, two relatively movable members are indicated by the numerals 300, 302. The member 300 is a relatively flat plate. The member 302 is a wheel which is journaled for rotation about the axis of a shaft 304.

The wheel 302 has a circumferential surface 306 with circumferentially spaced, detent-receiving holes 308, 310, 312, 314 formed therein. The members 302, 304 are relatively movable to successively present a series of contiguous portions of the circumferential surface 306 in spaced, side-by-side relationship to a part 320 of the member 302.

A hole 322 is formed through the part 320. A detent element, in the form of a hardened steel ball 324, is positioned in the hole 322. A spring clip 326 is carried on the part 320 and operates as described in conjunction with the spring clip 130 to bias the ball 324 into contact with the surface 306, and to project a tip portion 328 of the ball into selective ones of the holes 308, 310, 312, 314 when the members 300, 302 are in predetermined relative positions where the hole 322 aligns with the holes 308, 310, 312, 314.

As will be apparent from the foregoing description, the detent system of the present invention can be used with a wide variety of relatively movable members. While it is particularly well adapted for use with relatively movable lock members to provide a system which can be easily assembled and disassembled, and which permits great latitude in manufacturing tollerances during fabrication, it can also be used in many other applications.

While the detent elements used in the preferred practice of the present invention comprise hardened steel balls, it will be apparent to those skilled in the art that detent elements of other configurations and formed from other materials can be used with spring-clip type retaining systems of the type described. While the spring clips and detent elements used in the described example embodiments have been mounted on members which ordinarily remain stationary, it will be apparent to those skilled in the art that these elements will operate equally effectively if mounted on members which move. It is for this reason that the term "relatively movable members" has been employed throughout the description to designate that the detent system components can be mounted on either movable or stationary ones of two relatively movable members.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shalll cover, by suitable expression in the appended claims, whatever features of patentable novelty exist in the invention disclosed.

What is claimed is:

1. A detent system for releasably retaining relatively movable members in a predetermined position, comprising:

(a) a pair of members which are relatively movable to successively present a series of contiguous surface portions on one of the members in spaced, side-by-side relationship with a selected part of the other of the members;

(b) the part having one side which faces toward the contiguous surface portions and having an opposite side;

(c) a hole formed through the part and having one and opposite ends which open respectively through the one and opposite sides;

(d) a detent element movably carried in the hole and having a tip projecting from the one hole end for engaging the contiguous surface portions as the members have relative to each other;

(e) a detent receiving formation provided at a location along the contiguous surface portions and being adapted to receive the projecting tip of the detent element when the members are in a predetermined relative position; and, (f) spring clip means carried on the part and having one and opposite legs extending respectively along the one and opposite sides, with the one leg engaging the one side and with the opposite leg overlying the hole and biasingly engaging the detent element:

(i) for biasing the detent element toward the one member to hold the projecting tip in engagement with the contiguous surface portions as the members move relative to each other; and, (ii) for biasing the projecting tip into receiving engagement with the detent receiving formation when the members are in the predetermined relative position to releasably retain the members in the predetermined relative position.

2. The detent system of claim 1 wherein at least a selected one of the legs of the spring clip means is provided with an opening which receives a portion of the detent element to assist in retaining the spring clip means in place on the part.

3. The detent system of claim 1 wherein:

(a) an opening is provided between two independently movable tabs provided on the opposite leg;

(b) a portion of the detent element extends into the opening; and, (c) the tabs engage the detent element to bias it inwardly of the hole.

4. The detent system of claim 2 wherein the detent element projects through the opening.

5. The detent system of claim 2 wherein portions of the one leg which lie adjacent the opening project into the hole to assist in retaining the spring clip means on the part.

6. The detent system of claim 1 wherein both of the legs of the spring clip means are provided with openings which receive portions of the detent element to assist in retaining the spring clip means in place on the part, and the detent element projects through at least one of the openings.

7. The detent system of claim 1 wherein the spring clip means is of U-shaped configuration, its legs have substantially uniform cross-sectional areas along their lengths, and the legs are integrally interconnected by curved portions of lesser cross-sectional area than that of the legs.

8. The detent system of claim 1 wherein the members are movable relative to each other along a substantially linear path of travel.

9. The detent system of claim 1 wherein the members are movable relative to each other in substantially parallel planes.

10. The detent system of claim 1 wherein the members are movable relative to each other in substantially non-parallel planes.

11. The detent system of claim 1 wherein a first one of the members is mounted for sliding movement relative to a second one of the members.

12. The detent system of claim 1 wherein a first one of the members is mounted for rotation relative to a second one of the members.

13. A detent system for releasably retaining a pair of relatively movable members in a predetermined position, comprising:

(a) first and second members which are relatively movable to bring a first portion of the first member and a second portion of the second member into and out of a predetermined relative position wherein the first and second portions are arranged in spaced, side-by-side relationship;

(b) hole-defining means on the first portion defining a hole, one end of which opens toward and the other end of which opens away from the second portion when the first and second members are in the predetermined position;

(c) a detent element movably carried in the hole;

(d) detent element receiving means on the second portion defining a detent receiving formation facing toward the first portion when the first and second members are in the predetermined position for receiving a part of the detent element when the first and second members are in the predetermined position; and, (e) U-shaped spring clip means carried by the first movable member and having a pair of legs which overlie parts of the hole-defining means with each of the legs extending near a separate one of the opposite ends of the hole, one of the legs engaging the detent element and biasing it into receiving engagement with the receiving formation when the first and second members are in the predetermined position to releasably retain the first and second members in the predetermined position.

14. The detent system of claim 13 wherein the other of the legs is provided with an opening, and the detent element extends through the opening.

15. The detent system of claim 14 wherein portions of the other leg which lie adjacent the opening project into the hole to assist in retaining the spring clip means on the first movable member.

16. The detent system of claim 13 wherein the one leg is provided with an opening which receives a portion of the detent element.

17. The detent system of claim 13 wherein the legs of spring clip means have substantially uniform cross-sectional areas along their lengths, and the legs are integrally interconnected by curved portions of lesser cross-sectional area than that of the legs.

18. The detent system of claim 13 wherein the members are movable relative to each other along a substantially linear path of travel.

19. The detent system of claim 13 wherein the members are movable relative to each other in substantially parallel planes.

20. The detent system of claim 13 wherein the members are movable relative to each other in substantially non-parallel planes.

21. The detent system of claim 13 wherein a first one of the members is mounted for sliding movement relative to a second one of the members.

22. The detent system of claim 13 wherein a first one of the members is mounted for rotation relative to a second one of the members.

23. In a lock assembly of the type having a pair of members which are relatively movable to successively present a series of contiguous surface portions on one of the members in spaced, side-by-side relationship with a selected part of the other of the members, and wherein the one part has one side which faces toward the contiguous surface portions and having an opposite side, the improvement of a detent system comprising:

(a) a hole formed through the part and having one and opposite ends which open respectively through the one and opposite sides;

(b) a detent element movably carried in the hole and having a tip projecting from the one hole end for engaging the contiguous surface portions as the members move relative to each other;

(c) a detent receiving formation provided at a location along the contiguous surface portions and being adapted to receive the projecting tip of the detent element when the members are in a predetermined relative position; and, (d) spring clip means carried on the part and having one and opposite legs extending respectively along the one and opposite sides, with the one leg engaging the one side and with the opposite leg overlying the hole and biasingly engaging the detent element:

(i) for biasing the detent element toward the one member to hold the projecting tip in engagement with the contiguous surface portions as the members move relative to each other; and, (ii) for biasing the projecting tip into receiving engagement with the detent receiving formation when the members are in the predetermined relative position to releasably retain the members in the predetermined relative position.

24. The lock assembly of claim 23 wherein at least one of the legs of the spring clip means is provided with an opening which receives a portion of the detent element to assist in retaining the spring clip means in place on the part.

25. The lock assembly of claim 24 wherein portions of the one leg which lie adjacent the opening project into the hole to assist in retaining the spring clip means on the one part.

26. The lock assembly of claim 23 wherein both of the legs of the spring clip means are provided with openings which receive portions of the detent element to assist in retaining the spring clip means in place on the part, and the detent element projects through at least one of the openings.

27. The lock assembly of claim 23 wherein the spring clip means is of U-shaped configuration, its legs have substantially uniform cross-sectional areas along their lengths, and the legs are integrally interconnected by curved portions of lesser cross-sectional area than that of the legs.

* * * * *